US006761358B2

(12) United States Patent
Hallett

(10) Patent No.: US 6,761,358 B2
(45) Date of Patent: Jul. 13, 2004

(54) TRIVIA GAME AND METHOD OF PLAYING

(75) Inventor: James Hallett, Calgary (CA)

(73) Assignee: Entertainment Buffs Inc. (CA)

( * ) Notice: Subject to any disclaimer, the term of this patent is extended or adjusted under 35 U.S.C. 154(b) by 0 days.

(21) Appl. No.: 10/046,384

(22) Filed: Jan. 16, 2002

(65) Prior Publication Data

US 2003/0132575 A1 Jul. 17, 2003

(51) Int. Cl.[7] ..... A63F 9/18
(52) U.S. Cl. ..... 273/430; 273/242
(58) Field of Search ..... 273/236, 243, 273/244.2, 249, 302, 308, 429, 430, 431, 432

(56) References Cited

U.S. PATENT DOCUMENTS

| | | | | |
|---|---|---|---|---|
| 3,885,792 A | | 5/1975 | Breslow | |
| 4,359,226 A | * | 11/1982 | Neff | 273/243 |
| 4,932,667 A | | 6/1990 | Gorski et al. | |
| 5,121,928 A | | 6/1992 | Salerno-Sonneberg | |
| 5,193,818 A | * | 3/1993 | Leeson | 463/10 |
| 5,472,207 A | | 12/1995 | Sullivan, Jr. et al. | |
| 5,738,354 A | * | 4/1998 | Easley | 273/249 |
| 5,882,008 A | * | 3/1999 | Siegesmund | 273/249 |
| 6,017,035 A | * | 1/2000 | Glasser et al. | 273/308 |
| 6,070,874 A | * | 6/2000 | Ivers | 273/292 |
| 6,145,839 A | * | 11/2000 | Katsion et al. | 273/308 |
| 6,227,543 B1 | * | 5/2001 | Balog et al. | 273/243 |
| 6,419,232 B1 | * | 7/2002 | Sturdevant, II | 273/430 |

* cited by examiner

*Primary Examiner*—Jessica Harrison
*Assistant Examiner*—Alex F. R. P. Rada, II
(74) *Attorney, Agent, or Firm*—Sean W. Goodwin

(57) ABSTRACT

A game comprises a system wherein points are awarded for each matching identification of a work from a body of works associated with a personality, preferably a movie in which a particular actor appeared. Players move along a pathway according to the roll of a die. Each position on the pathway provides an instruction for drawing a card on which the picture of an actor or their name appears. The player identifies as many of the actor's works as possible within an allowed time. Optionally, an instruction will cause a player to miss a turn or to draw a card enabling the opportunity to earn bonus points. Alternate embodiments of the game may include any genre in which a body of works can be credited to a personality. Further, the game may be played on alternate game interfaces, such as a computer.

18 Claims, 3 Drawing Sheets

TRIVIA GAME AND METHOD OF PLAYING

FIELD OF THE INVENTION

The present invention relates to amusement devices and in particular to games and methods of testing a player's knowledge of a personality's body of works.

BACKGROUND OF THE INVENTION

Games are well known in which players or teams of players must travel about an endless pathway as determined by a chance device and wherein each player is challenged to display their knowledge about a subject as a result of a consequence indicator on the pathway.

Once such game, Trivial Pursuit™, utilizes a game board having an endless pathway of contiguous spaces or positions in the shape of a spoked wheel. Each of the positions displays an insignia signifying one of six categories from which questions are presented to the player(s). A card set is utilized to provide the challenge questions. The players move game pieces about the board according to the roll of a die. When a player successfully answers a question, they are rewarded with a marker which is fit into the game piece. Once a player has collected a marker for each of the categories, the player moves the game piece up the spokes of the wheel toward the center of the board and once there, must answer a question from a category of the other players choosing, in order to win the game.

U.S. Pat. No. 6,245,839 to Katsion et al. teaches a game based on knowledge of movies and actors. The game paraphernalia includes a score pad, timer and a plurality of playing cards having a pictorial representation and a name of an actor on one side and a list of movies in which they have appeared on the other. Players take turns within each round attempting to correctly guess a single one of the movies on the bottom face of a card that is selected at the beginning of the round. An incorrect answer renders a player out of the current round while a correct guess affords a player a point. The round is played until each of the players is rendered out or all of the listed movies have been identified. If two players tie at the end of the round, a tie-breaker card is selected by each and the player to identify the greatest number of movies listed on the back face of the other players card during a timed interval is awarded a point. The overall winner of the game is the player having the greatest number of points within a predetermined number of rounds.

Other movie-related games such as U.S. Pat. No. 5,121,928 to Salerno-Sonneberg are also known. Players advance about a game board using a pair of dice and are challenged to identify a title of a movie matching the movie category of the position on which the player's game piece has landed, aided by being read a quote from the movie which is printed on a card selected. Throughout the course of the game, players accumulate markers corresponding to the movie categories after successfully identifying movie titles in each category. Play is terminated when one player receives a marker for each of the movie categories.

Each of the known prior art games appeal to different age and interest groups and are intended to both entertain and challenge the knowledge of players.

SUMMARY OF THE INVENTION

The game of the present invention provides entertainment while challenging the knowledge of the players, or teams of players, under a time deadline, about bodies of works that are credited to personalities.

In one embodiment of the invention, players are tested on their knowledge of movies and actors. Each player is challenged to recognize an actor's face or their name as displayed on a card and, within a predetermined elapsed term of their turn, the current player is challenged to list as many movies as they can in which the actor appeared. The answers are verified by checking against a comprehensive list of credits provided with the game. Points are awarded for each correct answer. The movies are divided into categories called "Match Play", each category being assigned a number and representing a decade in which the movies were made. Thus, the current player is not only tested on his ability to recognize a personality and match the personality to their work, but is also tested on the player's knowledge of movies over a large span of time.

Preferably, the game comprises a game interface, a plurality of game pieces, a plurality of card sets as tokens including a "Match Play" card set for each category, a set of "Steal Play" cards, a chance device, a timer, a comprehensive book of bodies of works and a set of rules of play.

In a movie embodiment of the invention, the game interface comprises a star-shaped board having an endless pathway comprised of positions marked with indicia providing instructions regarding options for the selection of cards from the plurality of card sets or alternatively instructions to vary the course of play, such as missing a turn. Each player traverses the pathway, as a result of numbers generated by the chance device, and responds to the various instructions provided, collecting points as awarded for correctly identifying movies in which actors have appeared, until such time as one player has achieved a predetermined number of points or a predetermined time interval is complete.

DETAILED DESCRIPTION OF THE PREFERRED EMBODIMENT

Figure 1:
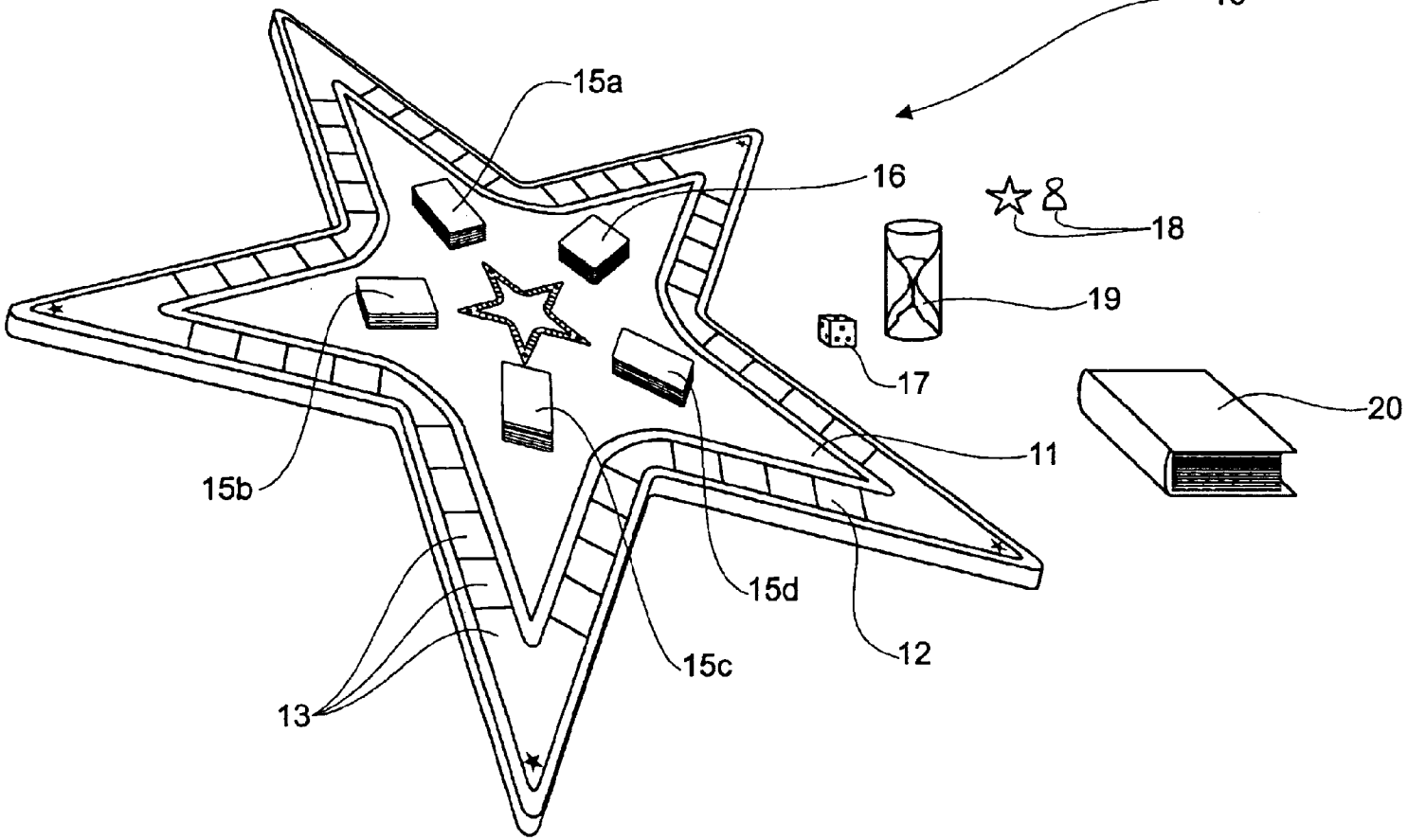
FIG. 1 is a perspective view of the game interface according to the present invention, including the components of the game.
Figure 2:
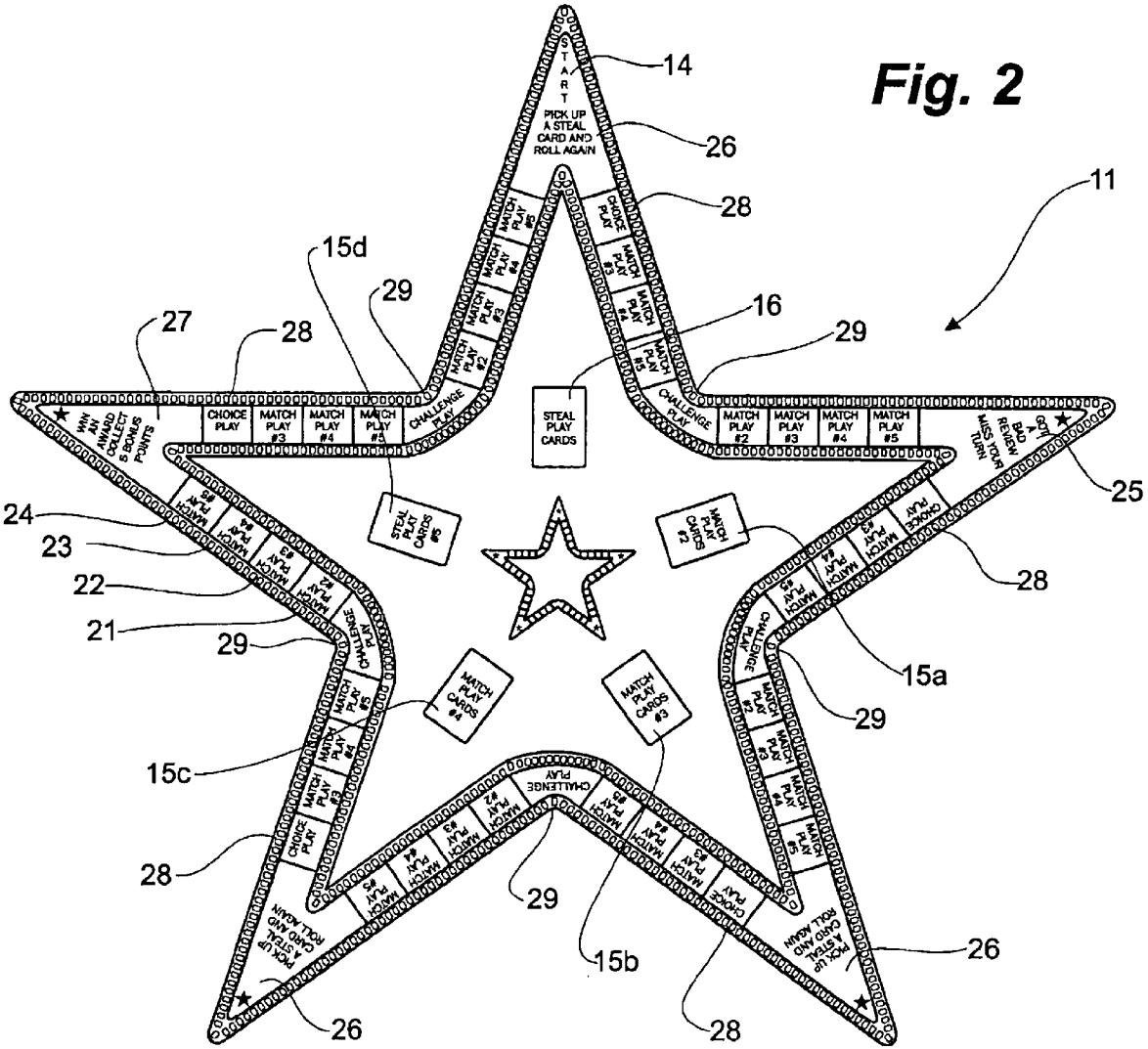
FIG. 2 is a plan view of the game board of the preferred embodiment of the invention.

Having reference to FIGS. 1 and 2, a game 10 comprises a game board 11 which enables a player to test their knowledge of personalities who are associated with a body of works. While this specification is described using movie trivia references, the game is equally applicable to the literary, artistic and musical personalities for example. Further, personalities include recognizable characters having bodies of works including entities whether dead, alive, real, corporate, fictional, animated or artificial.

In one embodiment, the game 10 deals with movie trivia and the game board 11 has the appearance of a 5-pointed star having an endless peripheral playing pathway 12. The pathway 12 is formed of contiguous positions (in a physical embodiment) or positions in a generalized sense. Each position is designated by indicia identifying one of a plurality of categories or consequences. Conveniently, one of the positions 13, marked with consequence indicia, is further divided to also define a "Start" position 14. A plurality of personality tokens 15, such as card sets 15*a*, 15*b*, 15*c*, 15*d*, are provided; one set for each of a plurality of categories of movies and a set of option tokens 16, such as "Steal Play" cards 16*a*. A chance device 17, such as a die, determines the rate of the player's advancement, position by position, about the pathway 12. A plurality of distinguishably different player identifier's or identification game pieces 18 are provided. A timer 19 determines an allowed or an elapsed time. Further, a reference 20 is provided, such as a book, which containing a comprehensive list of a body of works, such as movie credits, for each of the personalities represented in the game 10.

Categories of movies are marked on the game board 11, such as "Match Play" and are assigned a number, each category number representing movies divided into predetermined ranges of dates of the body of works which, in this one embodiment, are differentiated into decades. For example, Match Play #2 position 21 represents movies made from 1970 to 1979, Match Play #3 position 22 represents movies made from 1980 to 1989, Match Play #4 position 23 represents movies made from 1990 to 1999 and Match Play #5 position 24 represents movies made from 2000 to present.

The consequence indicia marked on the game board positions provide additional instruction to any player who lands on them during the course of play in order to vary the play routine or to score additional points. For example, the consequence indicia can include, "Got a bad review, Miss your turn" 25, "Pick up a Steal Card and roll again" 26, "Win an award, collect 5 bonus points" 27, "Choice Play" 28 and "Challenge Play" 29.

Figure 4:
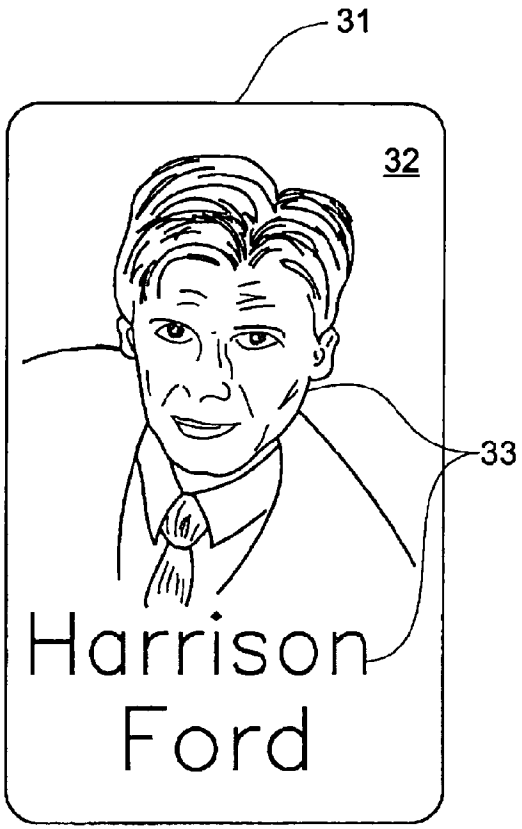
FIG. 4 is a plan view of a back face of a Match Play card.
Figure 3:
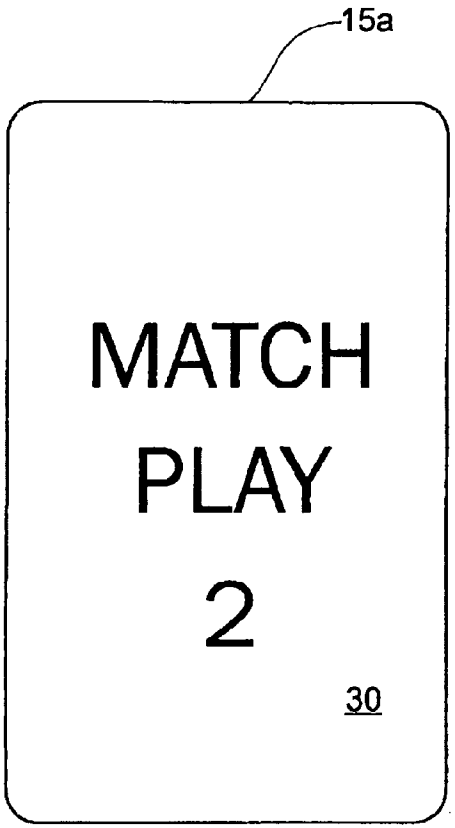
FIG. 3 is a plan view of a top face of a Match Play card.

Having reference to FIGS. 3 and 4, each set of personality tokens 15 (such as a plurality of card sets 15*a*–15*d* shown in FIG. 1), are marked with viewable indicia on a top side 30 of individual cards 31 with at least one category and preferably a plurality of a categories such as, "Match Play #2" 15*a*, Match Play #3" 15*b* and so on (FIG. 3). The category is normally viewable during play so that the current player is aware from which card set to draw their personality token 15. Each individual card 31 is also marked on a normally concealed bottom side 32 with a personality identifier 33 such as an image (such as a sketch, caricature, picture or photograph) and a name of the personality or actor (FIG. 4). The personality is normally concealed during play so that the current player is unaware of the personality until a later step in the turn.

Figure 5:
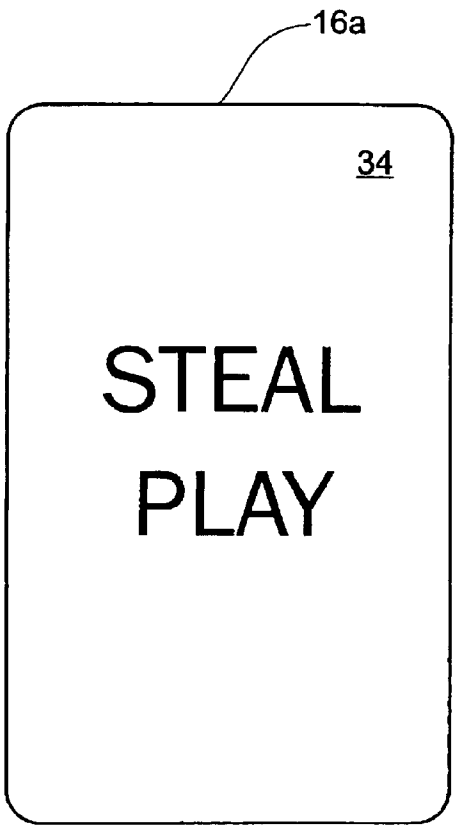
FIG. 5 is a plan view of a top face of a Steal Play card.

Referring to FIG. 5, option tokens 16, such as Steal play cards 16*a*, are marked with viewable indicia such as "Steal Play" on a top side 34.

Best seen in FIG. 2, to begin the game 10, the game board 1 is set out and the card sets 15*a*, 15*b*, 15*c*, 15*d*, 16*a* are positioned on designated areas within a central portion 35 of the game board 11. The card sets 15*a*, 15*b*, 15*c*, 15*d*, 16 are positioned so that only the top sides 30,34 of the cards are viewable. Game pieces 18 are placed on the "Start" position 14. Players, who may be individuals or teams of individuals, roll a die 17 to determine who begins the game 10. The highest number rolled determines who begins. Each player advances on the pathway 12, position 13 by position 13, as determined by the number generated by the die 17.

Each time a player ends their move on a position 13, being the current position, the player is either instructed to select a token or card from the card set 15*a*, 15*b*, 15*c*, 15*d*, or 16 that matches the category marked on the position 13 or in the case of a consequence indicator 25,26,27,28,29 to follow the instructions thereon.

When a player lands on "Match Play" positions 21, 22, 23, 24 the player selects a personality token or card from the "Match Play" card set 15*a*, 15*b*, 15*c*, 15*d* that matches the category on the corresponding marked position 21, 22, 23, 24. The timer 19 is started and the player turns over the card 31 and views the bottom side 32 displaying the actor's picture and name 33. The timer 19 sets a predetermined allowed or elapsed time and the player must identify as many movies as possible in which the particular actor appeared during the decade corresponding to the particular "Match Play" category 15*a*, 15*b*, 15*c*, 15*d*. At the end of the time interval, the movies are checked for a match against those listed in the reference book 20 for the particular actor within the particular decade. One point is awarded for each match or correct answer.

When a player lands on a "Select Play" position 40, the player can preferentially choose a personality token or card 31 from any of the "Match Play" card sets 15*a*, 15*b*, 15*c*, 15*d*.

When a player lands on a "Challenge Play" position 29, all of the teams of players play simultaneously. The player who landed on the "Challenge Play" position 29 determines the "Match Play" personality token or card set 15*a*, 15*b*, 15*c*, 15*d* to be used by rolling the die 17. A number one or a number six indicates that the player may freely choose amongst any of the "Match Play" card sets 15*a*, 15*b*, 15*c*, 15*d*. A number two indicates that the "Match Play #2" card set 15*a* is to be used, a three indicates that the "Match Play #3" card set 15*b* is to be used, and so on. The winner, between the players, is the one with the most correct answers. In the event of a tie, the winner is determined by re-playing the turn between the tied players with a newly selected match play card; a "play-off" in other words. The player who originally landed on "Challenge Play" position 29 re-rolls the die and selects the match play card to be used as described above.

When a player lands on a "Select a Steal Play card and Roll Again" 26 consequence indicator, the player selects an option token or "Steal Play" card 16*a* and retains it, deferring its use until such time as the player chooses to use the card 16*a*. When an opposing player lands on a "Match Play" position 21,22, 23, 24 the player holding the "Steal Play" card 16*a* may indicate that the player chooses to exercise the "Steal Play" card 16*a* and thereby gains an opportunity to be awarded additional points. The timer 19 is started and both the opposing player and the player using the "Steal Card" 16*a* attempt to identify and write down as many movies as possible during the timed interval. If the opposing player has no correct answers, the player using the "Steal Play" card 16*a* is awarded one point for every matching answer. If the opposing player has at least one correct answer, the player using the "Steal Play" card 16*a* is awarded no points. At some point during the turn, the player returns the card 16*a* to the "Steal Play" card set 16.

Play is terminated when one player collects a predetermined accumulated or total number of points, or a winner is determined as the player having the greatest number of points within a predetermined and overall time interval.

Optionally, bonus points may be awarded if the identification of the personality displayed on the "Match Play" card represents an image or identification 33 of the actor in a decade other than the one being tested; for example, if an image of the actor is only available from their younger years and the movie is in a decade category when they are in their latter years.

Further, bonus points may be awarded if an image of the actor is not available and the "Match Play" card 31 displays only a name as identification 33.

In alternate embodiments of the invention, the objective of the game can be altered to identify virtually any type of works from a body of works that can be attributed to personalities known to the public. Some common examples are the works of writers, television shows, television performers, musicians. Examples of categories for literary bodies of works could include non-fiction, fiction, and science fiction. Examples of artistic works used as game categories can include modern, landscape, Renaissance and abstract.

In yet another embodiment of the invention, regardless of the genre from which the body of works are selected, the game interface can be a video and input interface. The game board, lists and cards can be electronic representations which are likewise selected, viewed and identified. The interfaces can be computer, or television.

Further, the electronic format further enables the game to be presented in a televised format wherein the viewers can play along or interact using personal interface terminals and compatible interface equipment.

The embodiments of the invention for which an exclusive property or privilege is claimed are defined as follows:

1. A method of testing a player's knowledge of a personality's body of works comprising the steps of:

providing a game interface having an endless path of contiguous positions, each of the positions being associated with instructions to the players that affect the outcome of their turn;

assigning each player or team of players a distinguishably different player identifier; and playing the game for each player in turn by;

for a current player, operating a chance device to determine a number which determines a number of positions to be advanced in the turn and advancing a player identifier from a previous position to a current position;

selecting a token from at least one set of tokens, at least some of the tokens having viewable indicia which correspond to the instructions for the current position, and concealed indicia which contain an identification of a personality, the personality being associated with a body of works, the indicia and identified personality normally being concealed from the players, and should the selected token have such concealed indicia, then initiating a timing device to determine a pre-determined allowed time;

viewing the selected token which has concealed indicia containing the identification of a personality;

identifying as many works as possible from the personality's body of works during the allowed time, and when the allowed time expires;

comparing identified works from a pre-determined comprehensive body of works for the personality and allocating points for matching identified and pre-determined works so as to determine the number of points scored;

totaling the number of points scored for each player, until one player reaches a predetermined number of points to end the game; and repeating the step of operating the chance device through the step of totaling the number of points for each player in turn until one player reaches a predetermined number of points to end the game.

2. The method as described in claim 1 wherein the tokens are cards, each of which has a top side and a bottom side, the top side bearing the viewable indicia which is associated with instructions on one or more of the positions and the bottom side bearing the concealed indicia identifying the personality.

3. The method as described in claim 1 wherein the at least one set of tokens comprise at least two sets of tokens, each of which represent at least two differing categories of personality tokens, the game further comprising the step of selecting a token from between the at least two categories of personality tokens, the selected personality token having viewable indicia which correspond to the instructions for the current position, and concealed indicia which are normally concealed from the players.

4. The method as described in claim 3 wherein the at least two categories of personality tokens are differentiated by a date associated with bodies of works for testing a player's knowledge of the personality's body of works as of the date.

5. The method as described in claim 3 wherein the at least two categories of personality tokens are grouped by a range of dates associated with the bodies of works for testing a player's knowledge of the personality's body of works in each range of dates.

6. The method as described in claim 5 wherein the personalities are actors.

7. The method as described in claim 6 wherein the body of works are movies.

8. The method as described in claim 1 wherein the game interface is a game board.

9. The method as described in claim 1 wherein the chance device is a die.

10. The method as described in claim 1 wherein the bodies of works are movies.

11. The method as described in claim 1 wherein the game interface is a game board and the tokens are cards.

12. The method as described in claim 1 wherein the identification of the personality is an image of the personality.

13. A method of testing a player's knowledge of a personality's body of works comprising the steps of:

providing a game interface having an endless path of contiguous positions, each of the positions being associated with instructions to the players that affect the outcome of their turn;

assigning each player or team of players a distinguishably different player identifier; and playing the game for each player in turn by;

for a current player, operating a chance device to determine a number which determines a number of positions to be advanced in the turn and advancing a player identifier from a previous position to a current position;

selecting a token from at least one set of tokens, at least some of the tokens having viewable indicia which correspond to the instructions for the current position, and concealed indicia which contain an identification of a personality, the personality being associated with a body of works, the indicia and identified personality normally being concealed from the players, and should the selected token have such concealed indicia, then initiating a timing device to determine a pre-determined allowed time;

viewing the selected token which has concealed indicia containing the identification of a personality;

identifying as many works as possible from the personality's body of works during the allowed time, and when the allowed time expires;

comparing identified works from a pre-determined comprehensive body of works for the personality and allocating points for matching identified and predetermined works so as to determine the number of points scored;

totaling the number of points scored for each player, until one player reaches a predetermined number of points to end the game; and repeating the step of operating the chance device through the step of totaling the number of points for each player in turn until one player reaches a predetermined number of points to end the game;

wherein at least a set of option tokens are provided having viewable indicia thereon, further comprising the steps of:

selecting an option token during the players turn when the instructions at the player's current position so instruct;

deferring use of the player's option token until an opposing playe's turn;

choosing to exercise the option card and thus concurrently playing the turn with the opposing player during the opposing player's turn;

identifying as many works as possible; and if the opposing player has identified no works and has scored no points, and awarding an additional point to the player who exercised the option token for each of their matching identification of the works with the comprehensive list of works.

14. The method as described in claim 13 wherein the tokens are cards, each of which has a top side and a bottom side, the top side bearing the viewable indicia which is associated with instructions on one or more of the positions and the bottom side bearing the concealed indicia identifying the personality.

15. The method as described in claim 13 wherein the at least one set of tokens comprise at least two sets of tokens, each of which represent at least two differing categories of personality tokens, the game further comprising the step of selecting a token from between the at least two categories of personality tokens, the selected personality token having viewable indicia which correspond to the instructions for the current position, and concealed indicia which are normally concealed from the players.

16. The method as described in claim 15 wherein the at least two categories of personality tokens are differentiated by a date associated with bodies of works for testing a player's knowledge of the personality's body of works as of the date.

17. The method as described in claim 15 wherein the at least two categories of personality tokens are grouped by a range of dates associated with the bodies of works for testing a player's knowledge of the personality's body of works in each range of dates.

18. The method as described in claim 13 wherein the body of works are movies.

* * * * *